US007874560B1

(12) United States Patent
Dean et al.

(10) Patent No.: US 7,874,560 B1
(45) Date of Patent: Jan. 25, 2011

(54) SUSPENDED GAME PIECE CONSTRUCTION GAME

(75) Inventors: Scott Dean, Hertfordshire (GB); Matthew Donie, Ellington, CT (US); Joel Kramer, Enfield, CT (US)

(73) Assignee: Hasbro, Inc., Pawtucket, RI (US)

( * ) Notice: Subject to any disclaimer, the term of this patent is extended or adjusted under 35 U.S.C. 154(b) by 62 days.

(21) Appl. No.: 12/391,128

(22) Filed: Feb. 23, 2009

(51) Int. Cl.
*A63F 9/26* (2006.01)

(52) U.S. Cl. ..... 273/450

(58) Field of Classification Search ..... 273/440, 273/449, 450, 459
See application file for complete search history.

(56) References Cited

U.S. PATENT DOCUMENTS 3,402,929 A 9/1968 Glass et al.
3,589,723 A * 6/1971 Glass et al. ..... 273/450
3,614,106 A 10/1971 Morrison et al.
4,358,110 A * 11/1982 Youkstetter ..... 273/450
5,346,229 A * 9/1994 Hunter ..... 273/449
5,720,645 A 2/1998 Duggan
5,954,340 A 9/1999 Tedesco
7,178,805 B2 2/2007 Herbolich, Jr.
2005/0017457 A1* 1/2005 Dubinsky ..... 273/440

OTHER PUBLICATIONS

Monkeying Around 22232, International Playthings Inc. http://www.boardgamegeek.com/game/22232, Copyright 2004.
Swinging Snakes 24968, Parker Brothers http://www.boardgamegeek.com/game/24968, Copyright 1993.

* cited by examiner

*Primary Examiner*—Raleigh W. Chiu
(74) *Attorney, Agent, or Firm*—Perry Hoffman

(57) ABSTRACT

A suspended game piece construction game having a game assembly including a suspended ring assembly to which a plurality of game pieces may be attached in a multitude of different orientations and compositions. A base assembly is placed upon a flat surface, and serves as a support for the rest of the game assembly. An elongated linear member is mounted vertically to the top of the base assembly. A ring assembly is placed about the elongated linear member, and is free to move up and down along the elongated linear member. A top assembly is mounted to the top end of the elongated linear tube, and supports the ring assembly at the top of the elongated linear member during gameplay. A plurality of game pieces have features which allow them to be attached to the ring or to each other. During gameplay, players take turns attaching game pieces to the ring assembly, or to other game pieces that have already been attached. Players attempt to attach the pieces so as to avoid causing the ring assembly to fall. A player is eliminated from competition upon causing the ring assembly to fall.

20 Claims, 8 Drawing Sheets

SUSPENDED GAME PIECE CONSTRUCTION GAME

FIELD OF THE INVENTION

The present invention relates generally to a tabletop game, and more particularly, to a suspended game piece construction game of skill that includes a game assembly with a suspended ring assembly to which players attach game pieces.

BACKGROUND OF THE INVENTION

Tabletop games have long been a popular form of competitive entertainment. They exist in a large variety of forms, the board game being perhaps the best known. Another existing type of tabletop game is the suspended game piece construction game. Suspended game piece construction games typically require dexterity and strategy in adding and/or removing game pieces from some sort of composition or structure. The objective of such games is usually to avoid disturbing the balance or integrity of the structure, which would cause the structure or other objects to fall.

Several types of suspended game piece construction games have been patented in the past. Some include nothing more than a multitude of playing pieces to be interconnected until the composition of pieces is unable to support itself any longer, thus falling apart. Other suspended game piece construction games have a separate base member upon which game pieces are placed or stacked in series until the balance is such that the game pieces fall off of the base. Yet other suspended game piece construction games involve removing game pieces from a structure until that structure is no longer capable of supporting itself or other objects.

SUMMARY OF THE INVENTION

The present invention provides an improved suspended game piece construction game. The invention provides for a game assembly, a method for playing the game, and a game kit.

Briefly summarized, the game assembly provides a base assembly, an elongated linear member, a top assembly, a ring assembly, and game pieces. The base assembly is placed upon a flat surface, and supports vertically a linear member, which linear member supports above itself a top assembly. The ring assembly is placed about the linear member and suspended at the linear member's top end by the top assembly. Game pieces may be attached to the ring assembly, or may be attached to each other in a multitude of manners.

The invention also relates to a method for playing the game whereby players take turns attaching game pieces to the ring, or to pieces that have already been attached to the ring. The resulting assembly of pieces attached to the ring may overcome the force that is suspending the ring, causing the ring to fall. The player who causes the ring to fall is eliminated from competition.

BRIEF DESCRIPTION OF THE DRAWINGS

For the purpose of facilitating an understanding of the invention, the accompanying drawings and description illustrate a preferred embodiment thereof, from which the invention, its structures, its construction and operation, its processes, and many related advantages may be readily understood and appreciated.

DETAILED DESCRIPTION OF THE EMBODIMENTS

Figure 1:
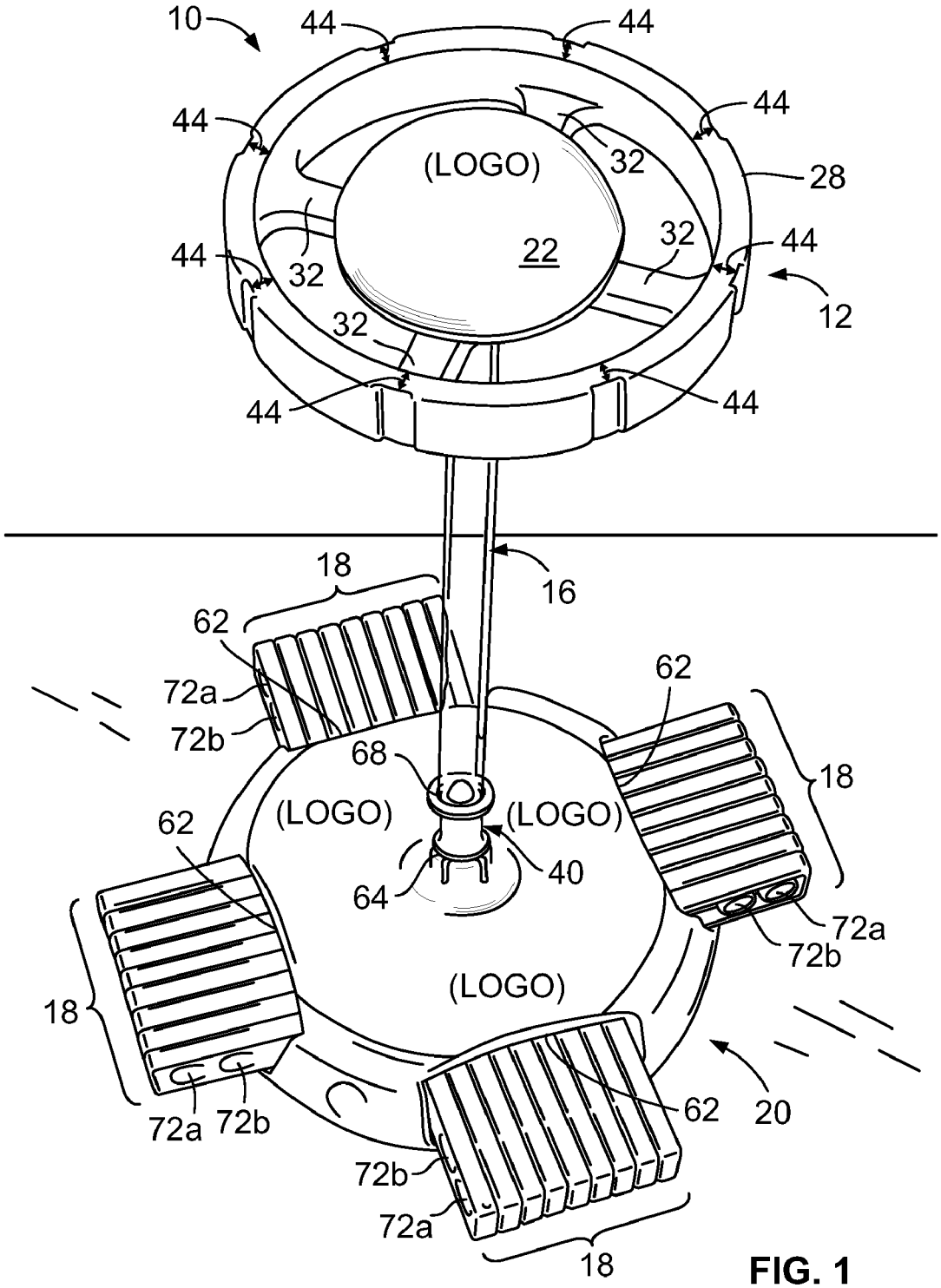
FIG. 1 is an isometric view of a preferred embodiment of the invention in the form of a game assembly illustrating a base assembly, elongated linear member, ring assembly, top assembly, and game pieces.
Figure 2:
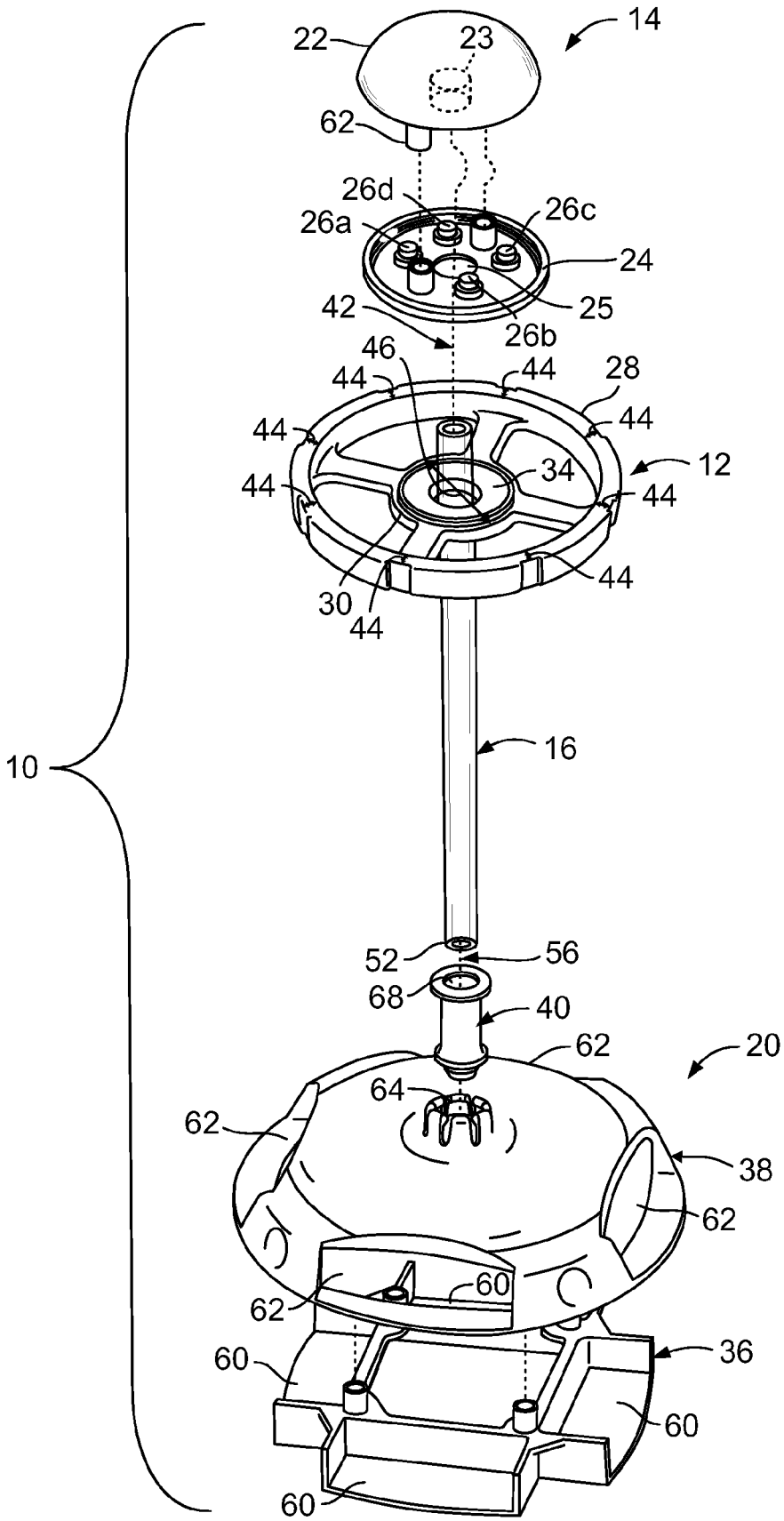
FIG. 2 is an isometric view of the game assembly disassembled into its individual parts.
Figure 3:
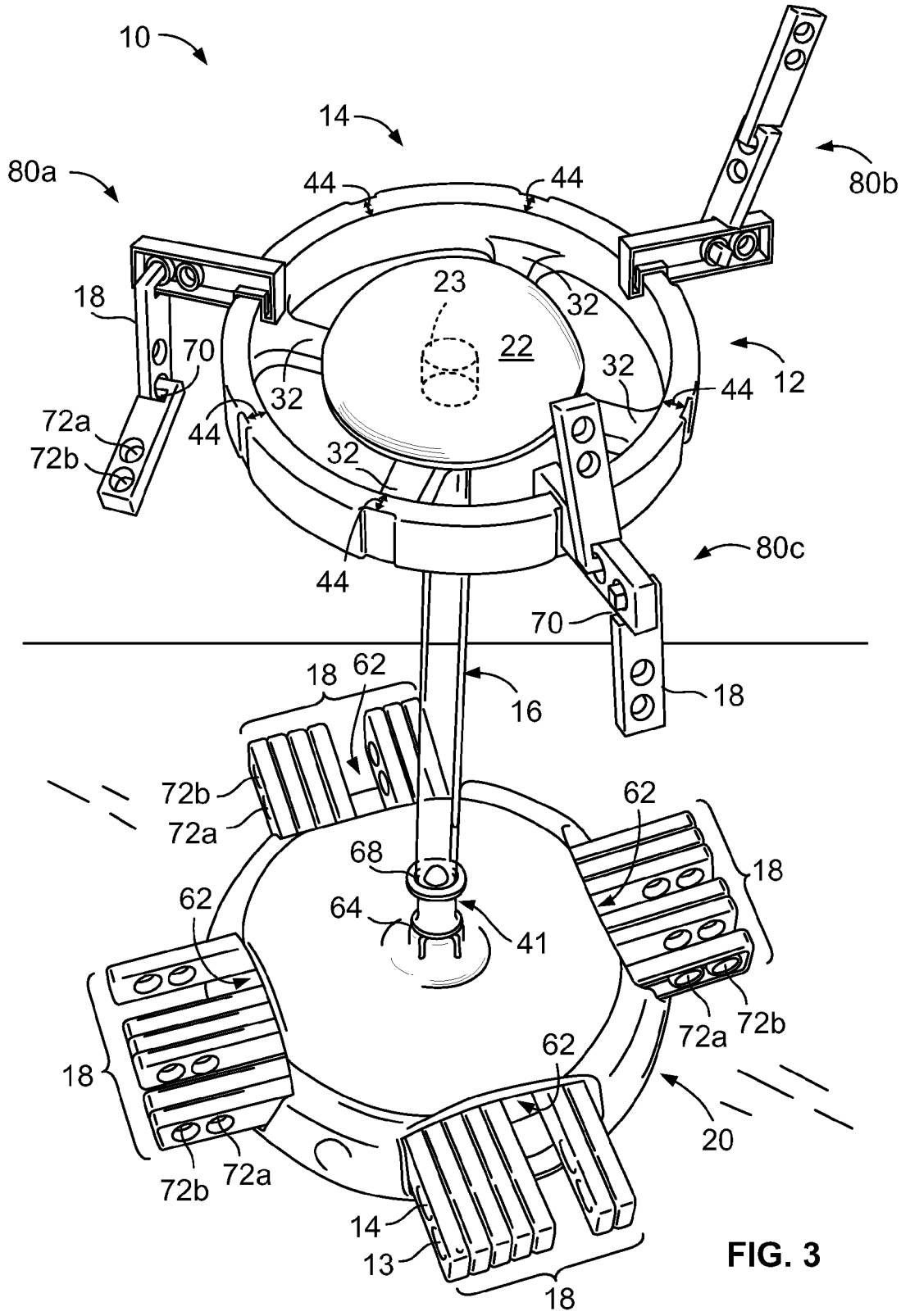
FIG. 3 is an isometric view of the game assembly shown in FIG. 1, with game pieces attached to the ring assembly and to each other, as would occur during gameplay.
Figure 4:
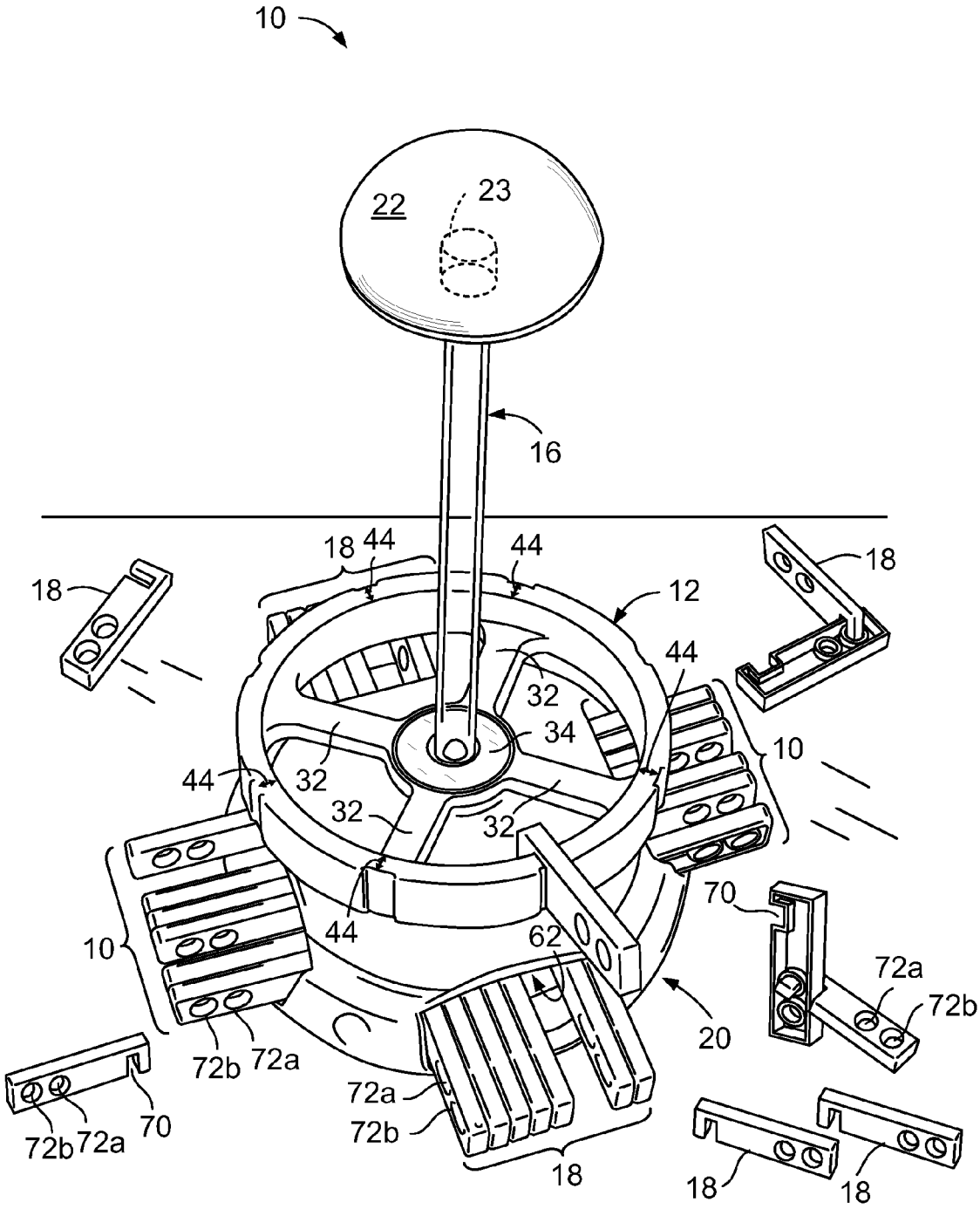
FIG. 4 is an isometric view of the game assembly similar to that shown in FIG. 1, but illustrating the ring assembly in a collapsed position, and the game pieces falling off of the ring assembly.
Figure 5:
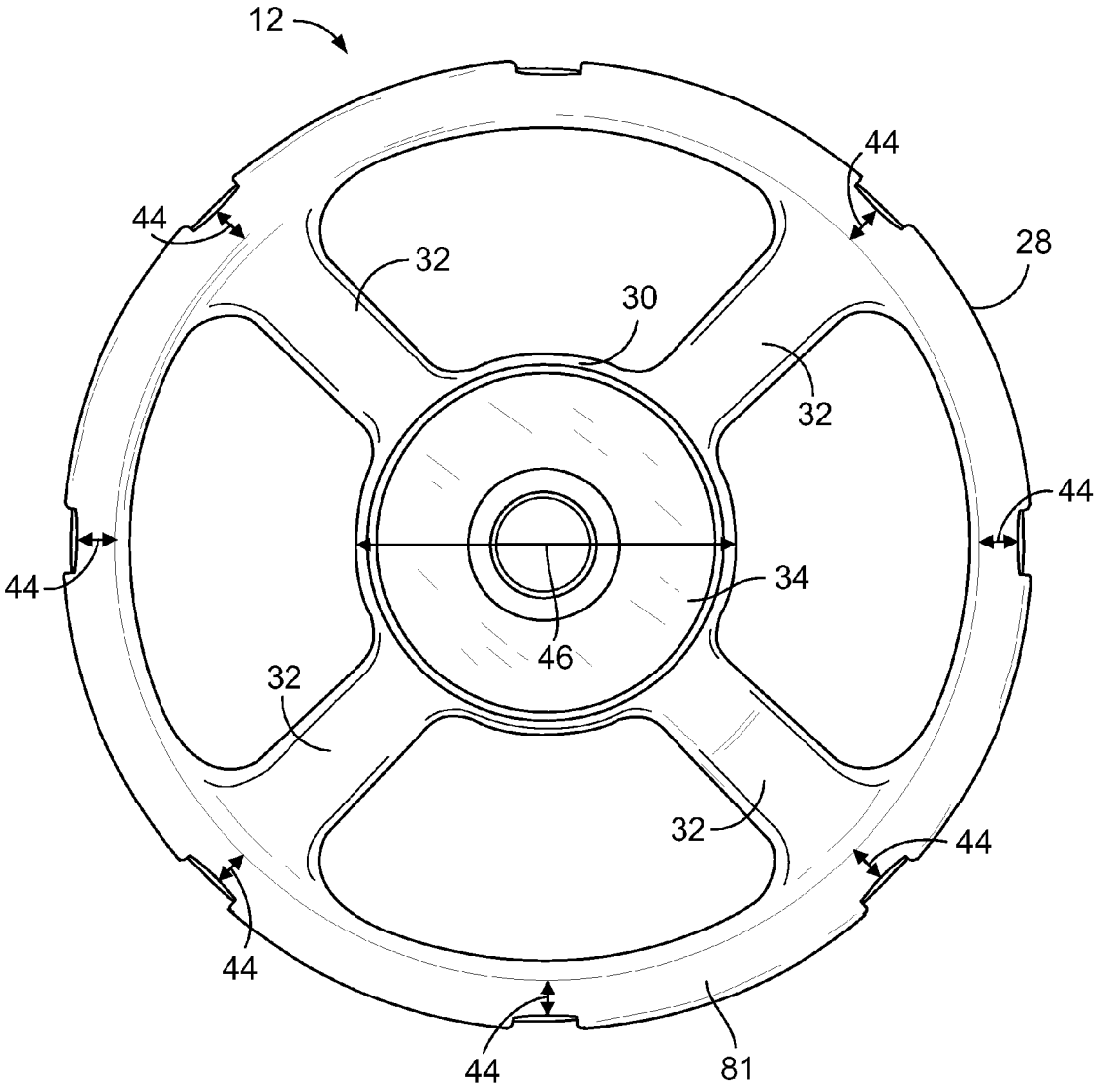
FIG. 5 is an enlarged top plan view of the ring assembly.

A preferred embodiment of the present suspended game piece construction game is a competitive game in which winning depends on players' ability to formulate strategy and dexterity in enacting that strategy. With reference to FIGS. 1-2, the game features a vertically-standing game assembly 10 including a suspended ring assembly 12 suspended by four magnets 26*a-d* within the top assembly 14. Players take turns attaching game pieces 18 to the suspended ring assembly, creating an ever more precarious structure. The various elements of the suspended game piece construction game assembly are shown in FIGS. 1-8. With reference to FIGS. 1-2, the elements generally include game pieces 18, a base assembly 20 to be placed on a flat surface, an elongated linear member 16 mounted to the base assembly, a suspended ring assembly 12 disposed about the elongated linear assembly and containing a metal disc 30, FIG. 2, and a top assembly 14, attached to the top end of the elongated linear member and containing magnets 26*a-d*, which suspends the suspended ring assembly directly below itself. The object of the game is to attach game pieces to the suspended ring assembly or to other pieces that have already been attached, as depicted in FIG. 3, without causing the suspended ring to fall. Players take turns attaching the game pieces. Each game piece attached applies further weight and torque to the suspended ring, bringing it another step closer to overcoming the magnetic force exerted by the top assembly, which holds the suspended ring assembly in place. A player wins when the opposing player causes the suspended ring assembly, and thus all of the connected pieces, to fall, as depicted in FIG. 4.

Figures 6A, 6B:
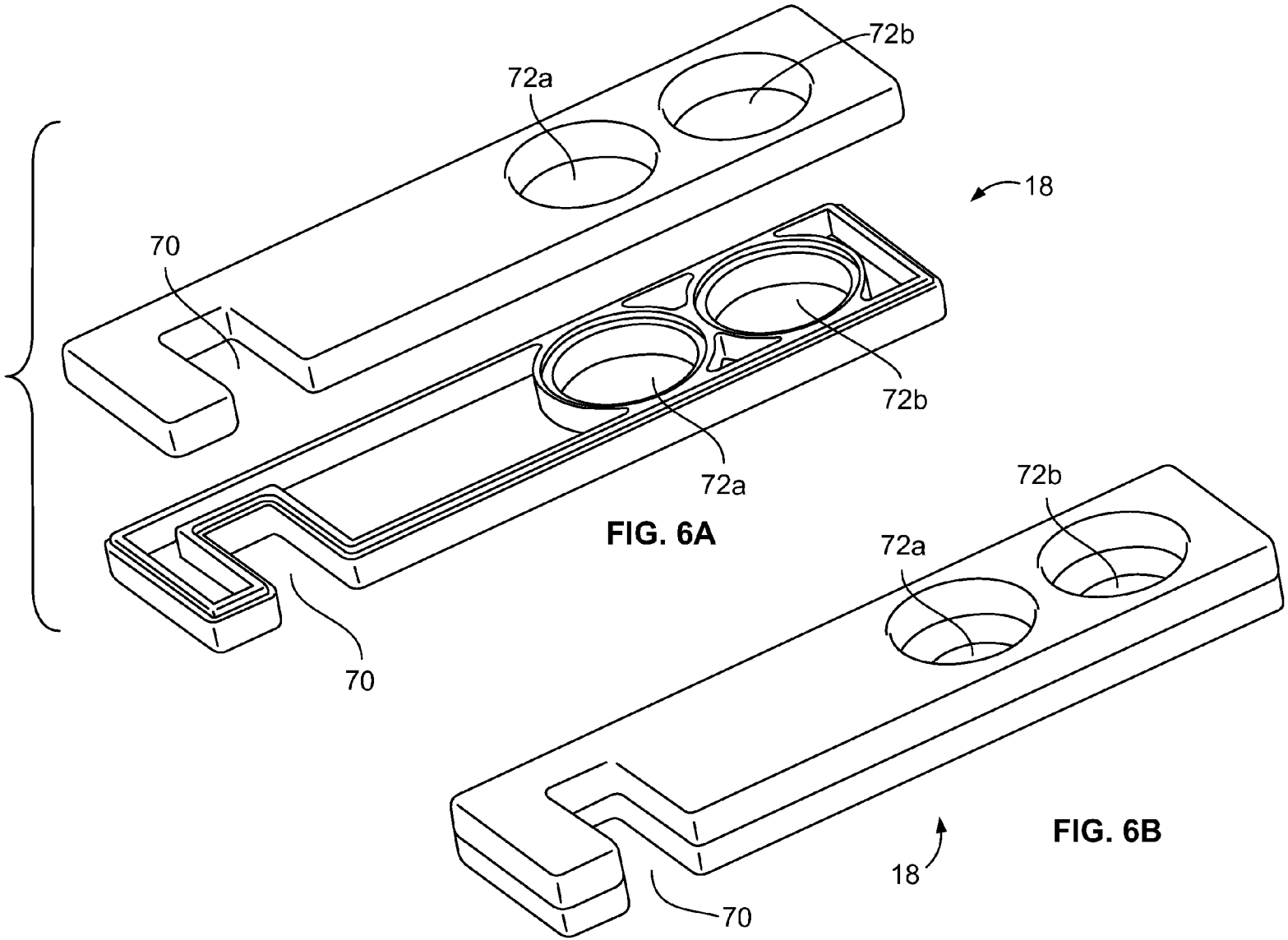
FIG. 6A is an enlarged isometric view of the two pieces which are permanently attached to form a game piece.
FIG. 6B is an enlarged isometric view of a game piece.

The game pieces 18 are rectangular in shape, roughly two inches long by one half of an inch wide, with a depth of about one quarter of an inch. With reference to FIG. 6, near one end of each game piece's length is defined two adjacent circular holes 72*a, b* through the entire depth of the game piece, approximately one quarter of an inch diameter, and aligned along the middle of the width of each game piece. A rectangular notch 70 is defined in the side of each game piece, located at the end of opposite the two holes 72*a, b*. As illustrated in FIG. 3, a game piece can be connected by its notch to the suspended ring assembly 12 and may also be attached in multiple orientations to either of the two holes 72*a, b* of another game piece, creating a game piece assembly, examples of which are demonstrated by 80*a-c*, FIG. 3. The different orientations in which game pieces can attach to each other makes possible a multitude of different game piece assemblies that players may create during gameplay. Of course, whether the suspended ring assembly 12 and all of the attached game pieces 18 fall depends directly upon the structure of the game piece assembly itself. Players should therefore take care not only to attach the game pieces without disturbing the ring, but also to place each piece in a good location and orientation. Through playing the game, players can get a feel for where and how to attach a game piece to minimize the likelihood of causing the ring to fall.

Figure 9:
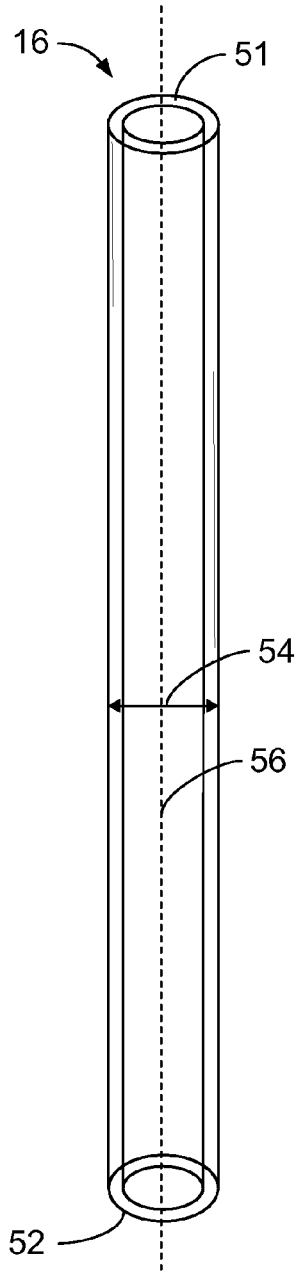
FIG. 9 is an isometric view of the elongated linear member.

With reference to FIG. 9, the elongated linear member 16 is an elongated linear tube with a bottom end 52, a top end 51, an outer diameter 54, and a center axis 56. The present described embodiment of FIG. 3 is provided in the form of the game assembly 10 having its base assembly 20 being supported on a substantially horizontal supporting surface such as a flat table top. The suspended ring assembly 12 described further below is axially disposed about the tube of the elongated linear member 16 with the multiplicity of game pieces 18 to be attached to the suspended ring assembly 12, by way of gameplay methods including: attaching game pieces to the ring member; avoiding causing the suspended ring assembly to fall; and eliminating a player from competition upon his or her causing of the suspended ring assembly to fall. The suspended ring assembly 12 is thusly spaced above the supporting surface axially and disposed about the elongated linear member 16, with the multiplicity of game pieces 18 adapted to be attached to the suspended ring assembly, wherein the game pieces 18 are provided for attaching above the supporting surface to the ring member. Accordingly the suspended ring assembly 18 is placed about the elongated linear member 16 as being free to move up and down along the tube thereof. As described, the top assembly is mounted to the top end of the tube, and supports the ring assembly at the top of the elongated linear member during gameplay. The plurality of game pieces have features which allow them to be attached to the ring or to each other. During gameplay, players take turns attaching game pieces to the ring assembly, or to other game pieces that have already been attached. Players attempt to attach the pieces so as to avoid causing the ring assembly to fall.

Figure 7:
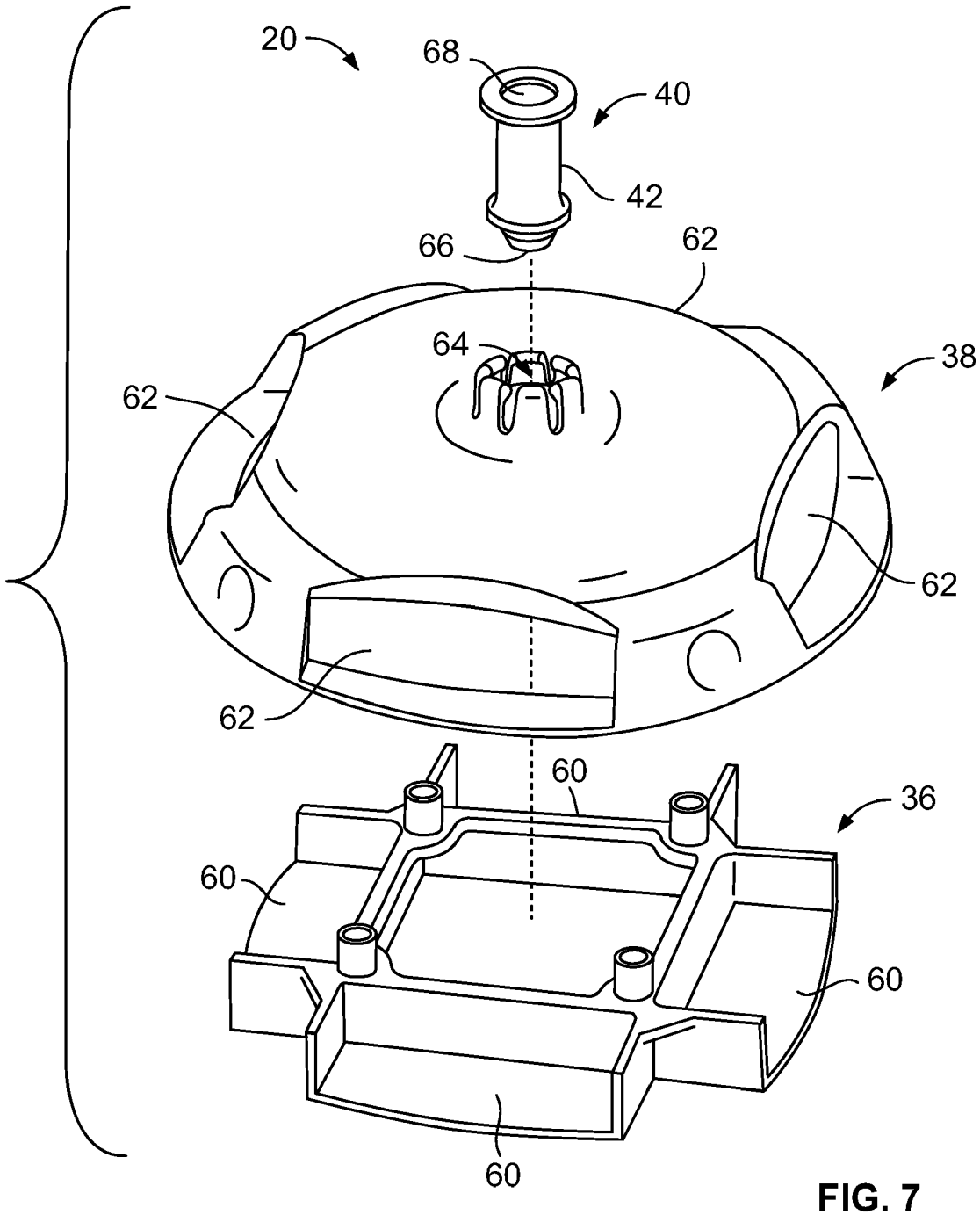
FIG. 7 is an isometric view of the disassembled members of the base assembly.

As depicted in detail in FIG. 7, the base assembly 20 includes a block retainer member 36, a base member 38, and a male snap member 40. The block retainer member 36 is to rest upon a flat, level surface upon which the game is to be played. The block retainer member contains four (4) alcoves 60 arranged in a square about the center of the block retainer member. Each alcove has three walls arranged in a "u"-shape, with the open end facing outward. Attached to the top of the block retainer member is the base member 38. The base member is shaped like a flat-topped dome, containing four openings 62 which align with the alcoves 60 of the block retainer member. In addition, at the top center of the base member is defined a female snap hole 64. The male snap member 40 has a circular snap 66 at its bottom end, which snaps into the female snap hole 64 on the base member, thus supporting vertically the male snap member at the top center of the base member. The top of the male snap member is a cylindrical socket 68 which receives and supports vertically the elongated linear member 16. The entire base assembly 20 serves primarily to vertically support the elongated linear member 16, with the its secondary function being storage of game pieces 18 in the alcoves 60 prior to their use in the game.

Figure 8:
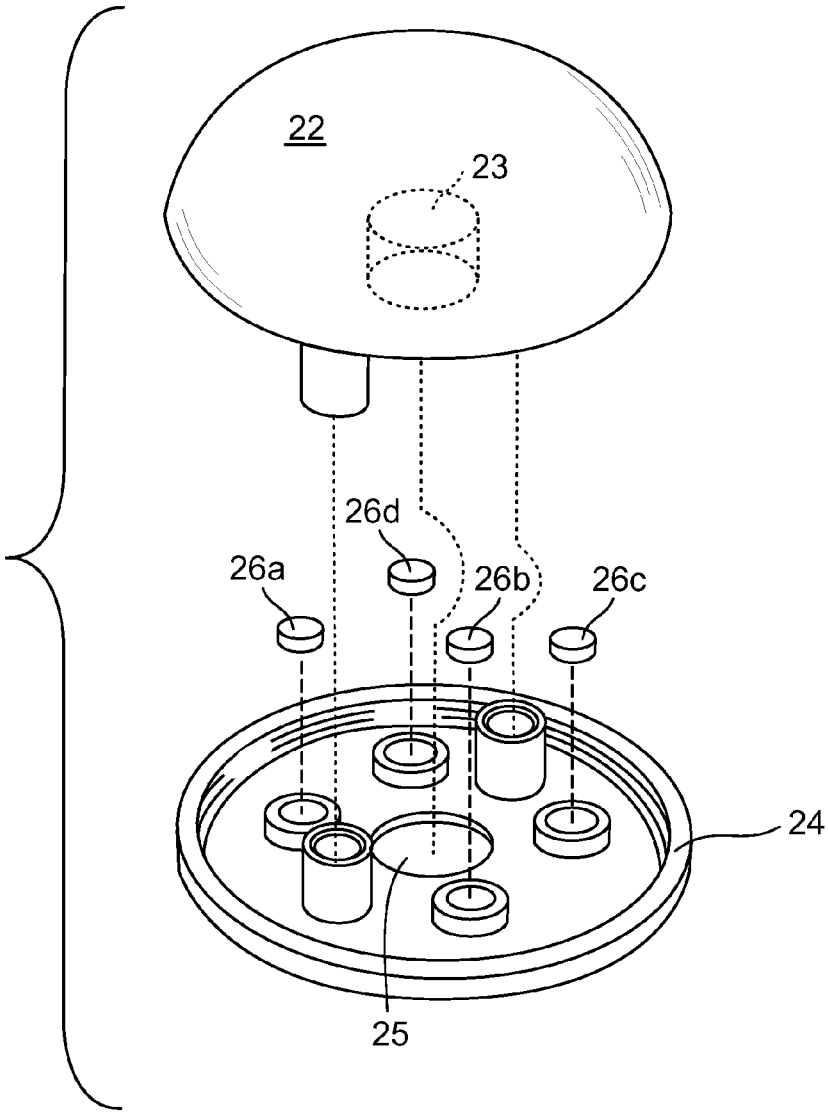
FIG. 8 is an isometric view of the disassembled members of the top assembly.

The top assembly 14, depicted in detail in FIG. 8, fits atop the elongated linear member 16, and includes a top cap member 22, a magnet mount member 24, and four (4) circular magnets 26*a*, 26*b*, 26*c*, 26*d*. The circular, dish-shaped magnet mount member 24 defines a hole 25 at its center through which the elongated linear member is received. In addition, to the top surface of the magnet mount member are attached four (4) cylindrical magnets 26*a*, 26*b*, 26*c*, 26*d*, located radially about the center hole 25. The dome-shaped top cap member 22 fits atop the circular dish-shaped magnet mount member 24. The bottom center of the top cap member 22 defines a cylindrical socket 23 that aligns with the center hole 25 through which the socket 23 receives the elongated linear member 16. The top assembly 14 serves to suspend the suspended ring assembly 12 via magnetic force during gameplay. This magnetic force is ultimately overcome by the forces exerted upon it by the game piece assembly created by the players through the normal course of the game, causing the ring and the attached game pieces to fall, as depicted in FIG. 4.

The suspended ring assembly 12, includes an outer ring 28 attached to an inner ring 30 by spokes 32, and a metal disc 34. The outer ring is disposed about and coplanar with the inner ring, and the two share the same center axis 42. The four (4) spokes 32 that attach the outer ring to the inner ring are spaced radially and evenly about the center axis 42. The outer ring has eight (8) locations of reduced thickness 44 spaced radially and evenly about the center axis to which the game pieces may be attached via their notches 70, as shown in FIG. 3. The inner ring receives directly above itself the metal disc 34, the two sharing the same center axis 42. The inner ring 30, and thus the entire suspended ring assembly 12, is disposed about elongated linear member 16 during gameplay. When so disposed, there is room for the suspended ring assembly to move laterally and tilt relative to the elongated linear member 16, as the inner ring's inner diameter 46 is larger than the elongated linear member's outer diameter 54. At the start of the game, players slide the suspended ring assembly 12 to the top of the elongated linear member 16. There, the suspended suspended ring assembly's metal disc 34, and thus the entire suspended suspended ring assembly 12, is magnetically suspended by the magnets 26*a*, 26*b*, 26*c*, 26*d* within the top assembly 14.

The game assembly 10, with the exceptions of the metal disc 30 and magnets 26*a-c*, may be molded of a suitable plastic and either fastened or snapped together. In the alternative, other suitable materials may be used. The game apparatus is robust, relatively inexpensive and easily manipulated, even for young children. It should be noted that in the preferred embodiment, the base assembly 20, elongated linear member 16, and top assembly 12 may be easily disassembled for storage purposes. As described the game kit and suspended game piece construction game assembly provides the multiplicity of game pieces being capable of interlocking with each other at plural points in a variety of arrangements. The suspended ring assembly facilitates arrangement about the elongated linear member with the described capability for movement along the elongated linear member, as the top assembly being attached thereof the suspended ring assembly near the top end of the elongated member. The base assembly receives the bottom end of the elongated linear member, supporting the elongated linear member vertically, with the suspended ring assembly disposed about the center axis of the linear member. The present described embodiment is provided to enable those skilled in the art to make and use the inventions set forth in the best mode contemplated for carrying out the suspended game piece construction game. Various modifications, equivalents, variations, and alternatives, how-ever, will be readily apparent to those skilled in the art. Any and all such modifications, variations, equivalents, and alternatives are intended to fall within the spirit and scope of the present invention.

From the foregoing, it can be seen that there has been provided features and advantages for an improved suspended game piece construction game assembly and game apparatus, as well as a method for playing the suspended game piece construction game. While a particular embodiment of the present invention has been shown and described in detail, it will be obvious to those skilled in the art that changes and modifications may be made without departing from the invention in its broader aspects. Therefore, the purpose of this description is to encompass all such changes and modifications that fall within the true spirit and scope of the invention as expressed in the appended claims. The matters set forth in the foregoing description and accompanying drawings are offered by way of illustrations only and not as claim limitations. The actual scope of the invention is to be defined by the subsequent claims when viewed in their proper perspective based upon the prior art.

What is claimed is:

1. A suspended game piece construction game assembly comprising:

a multiplicity of game pieces capable of interlocking with each other at plural points in a variety of arrangements;

an elongated linear member having a bottom end, a top end, an outer diameter, and a center axis;

a suspended ring assembly disposed axially about the elongated linear member and capable of movement along the elongated linear member;

a base assembly receiving the elongated linear member at the elongated linear member's bottom end for supporting the elongated linear member vertically over a substantially horizontal surface; and a top assembly attached to the top end of the elongated linear member and suspending the suspended ring assembly near the top end of the elongated member.

2. A game assembly as recited in claim 1 wherein:

the game pieces are identical.

3. A game assembly as recited in claim 1 wherein:

the game pieces have one location at which they may be attached to the suspended ring assembly or another game piece, and two locations at which another game piece may be attached.

4. A game assembly as recited in claim 1 wherein:

the suspended ring assembly is allowed a limited range of lateral movement and tilting with respect to said linear member.

5. A game assembly as recited in claim 1 wherein:

the elongated linear member is tubular, having an outer diameter.

6. A game assembly as recited in claim 4 wherein:

the suspended ring assembly comprises an inner ring with an inner diameter disposed about the elongated linear member's outer diameter, said inner diameter being greater than said outer diameter.

7. A game assembly as recited in claim 5 wherein:

the suspended ring assembly comprises an inner ring with an inner diameter disposed about the elongated linear member's outer diameter, said inner diameter being greater than said outer diameter.

8. A game assembly as recited in claim 1 wherein:

the suspended ring assembly comprises an outer ring with a plurality of sections of reduced thickness to which the game pieces may be attached.

9. A game assembly as recited in claim 1 wherein:

the suspended ring assembly comprises a metallic component and the top assembly contains one or more magnets which suspend said suspended ring assembly by attracting said metallic component.

10. A game assembly as recited in claim 1 wherein:

the base assembly contains alcoves which in which the game pieces are stored until they are attached.

11. A game kit, comprising:

a multiplicity of game pieces;

an elongated linear member with a bottom end, a top end, an outer diameter, and a center axis;

a base assembly for receiving the bottom end of the elongated linear member and for supporting the elongated linear member vertically above a supporting surface;

a top assembly receiving at its bottom center the top end of said linear member; and a suspended ring assembly disposed of about the center axis of said linear member adapted to be spaced above the supporting surface and capable of movement along said linear member.

12. A game kit as recited in claim 11 wherein:

the game pieces are rectangular and define a rectangular notch at one end and two circular holes at the opposite end.

13. A game kit as recited in claim 11 wherein:

said suspended ring assembly comprises an outer ring attached to an inner ring.

14. A game kit as recited in claim 11 wherein:

the base assembly contains alcoves in which the game pieces may be stored.

15. A game kit as recited in claim 11 wherein:

said suspended ring assembly contains a metal component and the top member contains one or more magnets.

16. A game kit as recited in claim 15 wherein:

the magnets within the top member are distributed evenly about the axis of the linear member.

17. A suspended game piece construction game assembly comprising:

a multiplicity of game pieces capable of interlocking with each other at plural points in a variety of arrangements;

an elongated linear member having a bottom end, a top end, an outer diameter, and a center axis;

a suspended assembly disposed axially about the elongated linear member and capable of movement along the elongated linear member;

a base assembly receiving the elongated linear member at the elongated linear member's bottom end for supporting the elongated linear member vertically over a substantially horizontal surface; and a top assembly attached to the top end of the elongated linear member and suspending the suspended assembly near the top end of the elongated member.

18. A game assembly as recited in claim 17 wherein:

the suspended assembly is allowed a limited range of lateral movement and tilting with respect to said linear member.

19. A game assembly as recited in claim 17 wherein:

the suspended assembly is a ring assembly comprising an outer ring attached to an inner ring.

20. A game assembly as recited in claim 17 wherein:

the suspended assembly comprises a metallic component and the top assembly contains one or more magnets which suspend said suspended assembly by attracting said metallic component.

* * * * *